United States Patent [19]

Martin et al.

[11] Patent Number: 4,772,362

[45] Date of Patent: Sep. 20, 1988

[54] ZINC ALLOY ELECTROLYTE AND PROCESS

[75] Inventors: Sylvia Martin, Utica; Kenneth D. Snell, Rochester Hills, both of Mich.

[73] Assignee: OMI International Corporation, Warren, Mich.

[21] Appl. No.: 59,296

[22] Filed: Jun. 8, 1987

Related U.S. Application Data

[63] Continuation of Ser. No. 807,047, Dec. 9, 1985, abandoned.

[51] Int. Cl.[4] ..... C25D 3/58

[52] U.S. Cl. ..... 204/44.2; 204/44.4

[58] Field of Search ..... 204/44.2, 44.5

[56] References Cited

U.S. PATENT DOCUMENTS

| | | | |
|---|---|---|---|
| 2,832,729 | 4/1958 | Safranek | 204/44.5 |
| 4,388,160 | 6/1983 | Rynne | 204/44.2 X |
| 4,488,942 | 12/1984 | Martin et al. | 204/44.2 |
| 4,543,166 | 9/1985 | Lash | 204/44.2 |
| 4,578,158 | 3/1986 | Kanamaru et al. | 204/44.2 |
| 4,592,809 | 6/1986 | Fong et al. | 204/44.2 |
| 4,643,805 | 2/1987 | Popescu | 204/44.2 |

FOREIGN PATENT DOCUMENTS

| | | | |
|---|---|---|---|
| 786418 | 11/1957 | United Kingdom | 204/44.2 |
| 2104920 | 3/1983 | United Kingdom | 204/44.2 |

OTHER PUBLICATIONS

International Application Publication No. WO83/02290, 7 Jul. 1983.

*Primary Examiner*—R. L. Andrews

*Attorney, Agent, or Firm*—Richard P. Mueller

[57] ABSTRACT

An improved aqueous acidic electrolyte suitable for electrodepositing zinc alloys comprising a combination of zinc and at least one metal selected from the group consisting of nickel, cobalt, iron, and mixtures thereof incorporating an effective amount of an additive agent for providing improved grain-refinement and enhancing the codeposition of the alloying metals in the zinc alloy deposit. The additive agent comprises a bath soluble terminally substituted polyoxyalkylene compound derived from the sulfation, amination, phosphating, chlorination, bromination, phosphonation, and sulfonation as well as combinations thereof;

(a) The polymerization of alkylene oxides selected from the group consisting of ethylene oxide, propylene oxide, glycidol, butylene oxide and mixtures thereof; and (b) the alkoxylation of mono and polyhydroxy compounds selected from the group consisting of hydroxyl containing alkyl, alkenyl, alkynyl, aryl, as well as mixtures thereof.

The present invention further encompasses the process of employing the aforementioned electrolyte for the deposition of functional and decorative zinc alloy electrodeposits.

8 Claims, No Drawings

ZINC ALLOY ELECTROLYTE AND PROCESS

This is a continuation of co-pending application Ser. No. 807,047, filed on Dec. 9, 1985, now abandoned.

BACKGROUND OF THE INVENTION

The present invention broadly relates to an improved electrolyte and process for electrodepositing zinc alloys, and more particularly, to an improved aqueous acid zinc alloy electrolyte containing novel additive agents for providing improved grain-refinement, reduced dendrite formation, increased adhesion and ductility and an unexpected increase in the codeposition of one or more alloying metals in the zinc alloy deposit.

Electrolytes incorporating zinc ions in further combination with one or a combination of nickel, cobalt, iron or mixtures thereof have heretofore been used or proposed for use for depositing zinc alloy deposits of a decorative or functional type on a variety of conductive substrates such as iron and steel, for example, to provide for improved corrosion resistance, enhance appearance and/or to build up the surface of a worn part enabling refinishing thereof to restore its original operating dimensions. Such zinc alloy electrolytes and processes are in wide spread commercial use for industrial or functional plating including strip plating, conduit plating, wire plating, rod plating, tube plating, coupling plating, and the like. A continuing problem associated with such prior art zinc alloy electrolytes has been the inability to achieve the desired grain-refinement of the alloy electrodeposit to provide the requisite semi-bright appearance and associated physical properties including adhesion and ductility. A further problem has been the inability to increase the percentage of the alloying metal constituent such as nickel, cobalt and/or iron in the zinc alloy electrodeposit in order to achieve a desired physical and chemical properties. The formation of dendrites on the substrate being plated at high current density areas has also been objectionable.

The present invention provides for an improved electrolyte for electrodepositing zinc alloys incorporating an additive agent or mixture of additive agents which provides for improved grain-refinement, a reduction in dendrite formation, increase in adhesion and ductility while further unexpectedly increasing the codeposition of the alloying metal ions achieving a zinc alloy electrodeposit incorporating higher percentages of such alloying elements.

SUMMARY OF THE INVENTION

The benefits and advantages of the present invention in accordance with the composition aspects thereof are achieved by an aqueous acidic zinc alloy electrolyte containing zinc ions in conventional amounts in further combination with controlled amounts of at least one additional alloying metal ion selected from a group consisting of nickel, cobalt, iron and mixtures thereof. The electrolyte further contains as an essential constituent, an additive agent present in an amount effective to achieve improved physical characteristics of the zinc alloy deposit comprising a bath soluble terminally substituted polyoxyalkylene compound derived from the sulfation, amination, phosphating, chlorination, bromination, phosphonation and sulfonation, as well as combinations thereof of:

(a) the polymerization of alkylene oxides selected from the group consisting of ethylene oxide, propylene oxide, glycidol, butylene oxide and mixtures thereof; and (b) the alkoxylation of mono and polyhydroxy compounds selected from the group consisting of hydroxyl containing alkyl, alkenyl, alkynyl, aryl, as well as mixtures thereof.

In addition to the foregoing constituents, the zinc alloy electrolyte may additionally contain various other additive agents of the types conventionally employed including buffering agents, supplemental brightening agents, bath soluble and compatible conductivity salts to increase the electrical conductivity of the electrolyte and the like.

In accordance with the process aspects of the present invention, a zinc alloy coating is electrodeposited on a conductive substrate employing the aforementioned aqueous acidic zinc alloy electrolyte which is controlled at a temperature typically ranging from about room temperature (60° F.) up to about 180° F. and is operated at an average cathode current density ranging from as low as about 1 up to as high as about 2000 amperes per square foot (ASF) or higher which will vary depending upon the specific type and composition of the electrolyte as well as the geometry and processing parameters employed in the plating operation.

Further benefits and advantages of the present invention will become apparent upon a reading of the Description of the Preferred Embodiments taken in conjunction with the specific examples provided.

DESCRIPTION OF THE PREFERRED EMBODIMENTS

The aqueous acidic zinc alloy electrolyte in accordance with the composition aspects of the present invention contains zinc ions present in an amount effective to electrodeposit zinc from the electrolyte and generally can range from as low as about 15 g/l up to saturation, with concentrations of from about 15 to about 225 g/l being more usual. Preferably, for most applications, the zinc ion concentration is controlled within a range of about 20 to about 200 g/l. The maximum concentration of zinc ions will vary depending upon the temperature of the electrolyte with higher temperatures enabling use of higher concentrations. The zinc ion concentration will also vary depending upon the type of electrolyte employed which may be of the chloride, sulfate, mixed chloride-sulfate, sulfamate, as well as the fluoroborate types. In acid chloride-type electrolytes, the zinc ion concentration is generally controlled at a level within the lower end of the permissible range whereas in acid sulfate-type electrolytes, the zinc ion concentration is generally controlled at a level within the upper range of the permissible concentrations.

The zinc ions are introduced into the electrolyte in the form of zinc anodes or soluble zinc salts such as a chloride, sulfate, sulfamate and/or fluoroborate salt in further combination with an acid such as sulfuric acid, hydrochloric acid, fluoroboric acid, sulfamic acid, or the like corresponding to the type of zinc salt employed. Generally the pH of the zinc alloy electrolyte is controlled within a range of about 0 up to about 7 with a pH of from about 2 to about 6 being preferred.

In addition to the zinc ions, the electrolyte further contains controlled amounts of at least one of the alloying metal ions including nickel, cobalt, and/or iron which similarly are introduced in the form of anodes or bath soluble salts of the alloying metal including the chloride, sulfate, fluoroborate, acetate, or sulfamate as well as mixtures thereof. When nickel and/or cobalt are employed as the alloying metal, each can be employed in the bath in amounts of from about 0.5 g/l up to about 120 g/l to provide alloy deposits containing from about 0.1 up to about 30 percent by weight of nickel and/or cobalt. Preferably, the alloy deposit contains from about 0.25 percent to a total of about 15 percent of both nickel and/or cobalt, and the bath under such conditions contains nickel and/or cobalt ions in an amount usually ranging from about 3 g/l to about 65 g/l, respectively.

When iron comprises an alloying metal in the electrolyte, the operating iron ion concentration can range of from about 5 g/l up to about 140 g/l with concentrations of from about 40 g/l up to about 100 g/l being preferred.

When iron ions are present in the electrolyte which is only weakly acidic or either neutral, such as at a pH of from about 4 to about 6.5, it is generally preferred to incorporate conventional complexing or chelating agents to maintain an effective amount of the iron metal ions in solution. Chelating or complexing agents which are particularly satisfactory for this purpose include citric acid, gluconic acid, glucoheptanoic acid, tartaric acid, ascorbic acid, isoascorbic acid, malic acid, glutaric acid, muconic acid, glutamic acid, glycollic acid, aspartic acid, and the like as well as their alkaline metal, ammonium, zinc or ferrous salts.

While the iron ions are introduced into the electrolyte in the ferrous state, ferric ions are formed during the plating operation and it has been found that excessive amounts of ferric ions are objectionable resulting in the formation of striations on the zinc alloy plated surface. Accordingly, it has been found desirable to control the ferric ion concentration at a level usually less than about 2 g/l. This can be accomplished by employing a soluble zinc or iron anode in the electroplating bath or, alternatively, by immersing metallic zinc or iron in the holding tank through which the electroplating solution is circulated. When no soluble anodes are employed or no zinc or iron metal is provided in the holding tank, proper control of the ferric ion concentration can be achieved employing suitable bath soluble and compatible organic and/or inorganic reducing agents such as, for example, bisulfite, isoascorbic acid, monosaccharides and disaccharides such as glucose or lactose.

It will be appreciated from the foregoing, that electrolytes can be formulated to provide for appropriate binary, ternary or quaternary alloys containing predominately zinc and at least one of the other three alloying metal constituents.

When ternary alloy deposits are desired containing zinc-nickel-iron or zinc-cobalt-iron, the concentration of the metal ions in the electrolyte are usually controlled so as to provide an alloy containing from about 1 percent to about 25 percent iron in combination with either about 0.1 to about 20 percent by weight nickel or about 0.1 to about 12 percent cobalt and the balance essentially zinc.

In addition to the metal ions present in the electrolyte, the electrolyte further contains as an essential ingredient an additive agent comprising a bath soluble terminally substituted polyoxyalkylene compound derived from the sulfation, amination, phosphating, chlorination, bromination, phosphonation and sulfonation, as well as combinations thereof of:

(a) the polymerization of alkylene oxides selected from the group consisting of ethylene oxide, propylene oxide, glycidol, butylene oxide and mixtures thereof; and (b) the alkoxylation of mono and polyhydroxy compounds selected from the group consisting of hydroxyl containing alkyl, alkenyl, alkynyl, aryl, as well as mixtures thereof.

The molecular weight of the additive agent or mixtures thereof is controlled to render the additive agent soluble in the electrolyte at the concentration desired. It will be appreciated that the additive agent may contain one terminal substitute group on the molecule or may contain more than one terminal substitute group depending upon the degree of substitution and the number of reactive hydroxyl groups on the molecule.

The concentration of the additive agent in the electrolyte will vary depending upon the concentration and types of other bath constituents present, the desired alloy deposit composition, and whether the electrodeposit is to be employed for functional or decorative purposes. Generally speaking, the additive agent is employed in an amount effective to produce a refinement of the grain of the electrodeposit, to reduce the tendency to form dendrites during the electrodeposition process, to enhance the adhesion and ductility of the deposit to the substrate, and to either increase the codeposition of the alloying metal ions in the zinc alloy deposit or to regulate the alloy content at a more uniform, desired level. For this purpose, concentrations as low as about 0.005 up to about 20 g/l have been found usable while concentrations of from about 0.02 up to about 5 g/l are more typical and preferred for most uses.

The additive agent can be employed by itself in combination with the metal ions in the electrolyte to produce a semi-bright electrodeposit typical of a functional plating. When a decorative electrodeposit is desired having enhanced brightness, supplemental brightening agents of the types known in the art can be incorporated in the electrolyte in the usual amounts. Typical of supplemental brighteners that can be employed to further enhance the crystal structure and brightness of the zinc alloy electrodeposit are those disclosed in U.S. Pat. Nos. 4,170,526; 4,207,150; 4,176,017; 4,070,256 and 4,252,619. When employed, such supplemental brightening agents can be used at concentrations up to about 10 g/l with concentrations as low as about 0.001 g/l being effective. Typically the concentration of the supplemental brightening agents range from about 0.01 up to about 5 g/l.

In addition to the foregoing essential and optional constituents, the electrolyte can further include supplemental additives such as buffers and bath modifiers such as boric acid, acetic acid, citric acid, benzoic acid, salicylic acid, as well as their bath soluble and compatible salts, ammonium chloride and the like. Other bath soluble and compatible salts such as ammonium sulfate, ammonium chloride or bromide, sodium chloride, potassium chloride, ammonium fluoroborate, magnesium sulfate, sodium sulfate, and combinations thereof and the like can also be employed in amounts usually ranging from about 20 up to about 450 g/l to increase the electrical conductivity of the electrolyte. Typically, such conductivity salts comprise alkali metal salts such as chlorides, sulfates, sulfamates and fluoroborates.

In accordance with the process aspects of the present invention, the zinc alloy electrolyte is employed to electrodeposit a desired zinc alloy on a conductive substrate employing electrolyte temperatures ranging from about room temperature (60° F.) up to about 180° F. and more typically, from about 70° to about 140° F. The electrodeposition of the zinc alloy can be carried out at current densities ranging from as low as about 1 up to about 2000 ASF or higher. For decorative chloride-type electrolytes, current densities of from about 1 to about 80 ASF are generally preferred, whereas for functional sulfate-type or chloride-type electrolytes, current densities of from about 20 to about 2000 ASF can be employed. During the electrodeposition process, the bath or electrolyte is preferably agitated mechanically or by solution circulation or part movement. While air agitation can be employed, the use of air agitation with electrolytes containing iron ions is less desirable due to the tendency to increase the formation of ferric ions in the bath.

In order to further illustrate the electrolyte composition and process of the present invention, the following examples are provided. It will be understood that the examples are provided for illustrative purposes and are not intended to be limiting of the scope of the present invention as herein described and as set forth in the subjoined claims.

EXAMPLE 1

For comparative purposes, an aqueous acidic chloride-type electrolyte was prepared suitable for depositing a zinc-iron alloy containing 80 g/l zinc chloride, 255 g/l ferrous chloride tetrahydrate, 50 g/l ammonium chloride and 10 g/l diammonium hydrogen citrate. The pH of the electrolyte was about 2 and was controlled at a temperature of about 50° C.

The electroplating bath was employed for electrodepositing a zinc-iron coating on a rotating steel rod cathode of a diameter of ¼ inch providing a surface velocity of 200 feet per minute. Soluble zinc anodes were immersed in the electrolyte and plating took place at an average cathode current density of about 500 ASF. The electrodeposition continued until a deposit of about 0.5 mil was obtained.

The foregoing electrolyte devoid of any additive agent of the present invention produced a rough, almost black appearing electrodeposit containing 18.6% by weight iron.

EXAMPLE 2

To the electrolyte as described in Example 1, 1 g/l of sulfated 2,4,7,9-tetramethyl-5-decyne-4,7-diol ethoxylated with 30 moles ethylene oxide was added. A rotating cathode was again plated under the same conditions as described in Example 1. A semi-bright silver deposit was obtained containing 41.2% by weight iron.

EXAMPLE 3

For comparative purposes, an aqueous acidic sulfate-type electrolyte was prepared suitable for depositing a zinc-iron alloy containing 110 g/l zinc sulfate monohydrate, 370 g/l ferrous sulfate heptahydrate, 10 g/l of diammonium hydrogen citrate and 10 g/l of ammonium sulfate.

The electrolyte was employed for the electroplating a rotating cathode under the same conditions as described in Example 1. A medium dark grey, grainy, slightly rough deposit was obtained containing 13.8% by weight iron.

EXAMPLE 4

To the electrolyte as described in Example 3, 0.25 g/l of sulfated 2,4,7,9-tetramethyl-5-decyne-4,7-diol ethoxylated with 30 moles ethylene oxide was added and a rotating cathode was electroplated under the same conditions as described in Example 1. A semi-bright, silver deposit was obtained containing 21.4% by weight iron.

EXAMPLE 5

For comparative purposes, an electrolyte as described in Example 3 was prepared to which an additive comprising polypropylene glycol of a molecular weight of about 750 was added. After mixing, oil formed on the surface of the electrolyte indicating that the solubility of the additive agent was too low for testing.

EXAMPLE 6

Example 5 was repeated with the exception that a sulfated polypropylene glycol of a molecular weight of about 750 was added at a concentration of 0.1 g/l. A rotating cathode was plated under the same condition as described in Example 1 and a lustrous silver, semi-bright deposit was obtained containing 21.6% by weight iron.

EXAMPLE 7

To the electrolyte as described in Example 3, 0.1 g/l of an additive agent comprising sulfated polyethylene glycol of a molecular weight of about 1450 was added.

A rotating cathode was electroplated under the same conditions as described in Example 1 producing a zinc-iron alloy having a bright silver appearance and containing 17% by weight iron.

EXAMPLE 8

To the electrolyte described in Example 3, 0.5 g/l of an additive agent was added comprising a sulfated polyethylene glycol of an average molecular weight of about 200.

A rotating cathode was electroplated under the same conditions as described in Example 1 producing a zinc-iron alloy deposit which was reflective, somewhat grainy and of a light silver-grey appearance. The alloy contained 13.8% by weight iron.

EXAMPLE 9

An aqueous acidic sulfate-type electrolyte was prepared suitable for electrodepositing a zinc-nickel alloy containing 205 g/l zinc sulfate monohydrate, 308 g/l nickel sulfate hexahydrate and 0.5% by volume of concentrated sulfuric acid. The electrolyte was of a temperature of about 65° to 70° C. and a rotating cathode of the type described in Example 1 was electroplated at an average cathode current density of 1,000 ASF at a rotation rate to provide a surface velocity of 300 feet per minute.

The foregoing electrolyte was employed for electrodepositing a zinc-nickel alloy on the rotating cathode employing a lead anode containing 0.1% by weight silver. The resultant zinc-nickel alloy deposit was smooth and of a silvery semi-bright appearance containing an average of about 13 to 14% by weight nickel, but had the tendency to exhibit poor adhesion and severe microcracking on standing.

EXAMPLE 10

The electrolyte as described in Example 9 as modified by the addition of an additive agent comprising sulfated 2,3,7,9-tetramethyl-5-decyne-4,7-diol ethoxylated with 30 moles ethylene oxide at a concentration of 0.035 g/l. A rotating cathode was electroplated under the same conditions as described in Example 9 and a lustrous silver semi-bright zinc-nickel deposit was obtained containing an average of about 5 to about 6% by weight nickel with good adhesion and deposit stability. This amount of nickel in the alloy is known to give good atmospheric corrosion resistance.

EXAMPLE 11

For comparative purposes, an aqueous acidic sulfate-type electrolyte was prepared suitable for electrodepositing a zinc-cobalt alloy containing 500 g/l zinc sulfate monohydrate, 50 g/l cobalt sulfate heptahydrate and 2% by volume of concentrated sulfuric acid. The electrolyte was controlled at a temperature of 32° C.

A rotating cathode of a type described in Example 1 was electroplated at an average cathode current density of 1,000 ASF with a cathode rotation speed to provide a surface velocity of 125 feet per minute. Lead anodes were employed.

The resultant zinc-cobalt alloy deposit was of a dull, grey appearance and contained 0.1% by weight cobalt.

EXAMPLE 12

To the electrolyte as described in Example 11, 0.3 g/l of an additive agent was added comprising sulfated polypropylene glycol of a molecular weight of 750. A rotating cathode was plated under the same conditions as described in Example 11 producing a zinc-cobalt alloy deposit of a silver, semi-bright appearance which upon analysis contained 0.33% by weight cobalt. This amount of cobalt is expected to increase corrosion protection by 50% over a pure zinc deposit.

EXAMPLE 13

An aqueous acidic chloride-type electrolyte was prepared suitable for electrodepositing a decorative zinc-nickel alloy deposit of a semi-bright appearance containing 100 g/l zinc chloride, 130 g/l nickel chloride hexahydrate, 210 g/l ammonium choloride and 10 g/l of sodium acetate. The pH of the electrolyte was about 5. To the foregoing electrolyte, an additive agent was added at a concentration of 0.75 g/l comprising sulfated 2,4,7,9-tetramethyl-5-decyne-4,7-diol ethoxylated with 30 moles ethylene oxide.

A flat steel part was electroplated at an average cathode current density of 30 ASF in the electrolyte controlled at 100° F. in the presence of air agitation. The resultant plated panel had a zinc-nickel alloy deposit which was of a matte appearance and upon analysis contained 8% by weight nickel.

EXAMPLE 14

To the electrolyte described in Example 13, a brightening agent was added to produce a fully bright decorative zinc-nickel alloy deposit. The brightening additive comprised benzal acetone at a concentration of 0.05 g/l.

An identical steel part as described in Example 13 was plated in the presence air agitation under the same conditions described in Example 13. A fully bright, decorative quality electrodeposit was obtained which upon analysis revealed a concentration of 9.7% by weight nickel.

EXAMPLE 15

An aqueous acidic chloride-type electrolyte was prepared suitable for electrodepositing a semi-bright decorative zinc-cobalt alloy containing 52 g/l zinc chloride, 10.4 g/l cobalt chloride hexahydrate, 140 g/l sodium chloride, 30 g/l boric acid, 1.6 g/l sodium benzoate and as an additive agent, 1 g/l of sulfated 2,4,7,9-tetramethyl-5-decyne-4,7-diol ethoxylated with 30 moles ethylene oxide. The electrolyte was at a pH of 5.2.

Steel nuts were placed while in a rotating plating barrel with the rotation of the barrel providing agitation. The average cathode current density was about 5 ASF. Upon completion, the plated articles were inspected and observed to have a uniform, semi-bright zinc-cobalt electrodeposit which upon analysis contained 0.3% by weight cobalt.

EXAMPLE 16

To the electrolyte as described in Example 15, brightening agents were added to produce a fully-bright decorative zinc-cobalt deposit. The brightening additives comprised 40 mg/l benzal acetone and 2 mg/l butyl nicotinate dimethyl sulfate quaternary.

Steel screws were electroplated in a rotating barrel with the barrel providing bath agitation. The screws were electroplated at an average cathode current density of 10 ASF. The resultant plated screws upon inspection were found to have a fully-bright and very decorative appearance and upon analysis the alloy contained 0.75% by weight cobalt.

EXAMPLE 17

An aqueous acidic chloride-type electrolyte was prepared suitable for electrodepositing a semi-bright decorative zinc-cobalt alloy containing 52 g/l zinc chloride, 10.4 g/l cobalt chloride hexahydrate, 140 g/l sodium chloride, 30 g/l boric acid, 1.6 g/l sodium benzoate and as an additive agent, 4 g/l of sulfated 2,2-Bis(p-hydroxyphenyl) propane ethoxylated with 26 moles ethylene oxide. The electrolyte was at a pH of 5.2.

Steel nuts were plated while in a rotating plating barrel with the rotation of the barrel providing agitation. The average cathode current density was about 5 ASF. Upon completion, the plated articles were inspected and observed to have a uniform, semi-bright zinc-cobalt electrodeposit which upon analysis contained 0.45% by weight cobalt.

EXAMPLE 18

For comparative purposes an aqueous acidic sulfate-type electrolyte was prepared suitable for depositing a zinc-iron alloy containing 110 g/l zinc sulfate monohydrate, 370 g/l ferrous sulfate heptahydrate and was of a pH of 2.

A moving steel strip, 4 inches wide, was plated for a period of one minute in the electrolyte employing zinc anodes at an average cathode current density of 500 ASF. The electrolyte was controlled at a temperature of 50° C. and the velocity of the cathode through the electrolyte was 200 feet per minute. The plated cathode on inspection had a grainy, grey, dendritic and non-uniform appearance and upon analysis contained 12.8% by weight iron.

EXAMPLE 19

To the electrolyte as described in Example 18, 10 mg/l of an additive agent was added comprising a chlorinated polyethylene glycol of an average molecular weight of 1,450 and a steel cathode was again plated under the same conditions as described in Example 18. The resultant electrodeposit was reflective, fine-grained and of a uniform semi-bright appearance. Upon analysis, the zinc-iron alloy contained 13.1% by weight iron.

EXAMPLE 20

To the electrolyte as described in Example 18, 0.1 g/l of an additive was added comprising a phosphated polyethylene glycol of an average molecular weight of 200 and a steel cathode was again plated in accordance with the procedure as described in Example 18. The resultant zinc-iron alloy deposit was of a blue-grey, semi-bright appearance and upon analysis contained 14.4% by weight iron.

EXAMPLE 21

To the electrolyte described in Example 18, 25 mg/l of an additive was added comprising a terminally aminated block polymer of ethylene and propylene oxides having an average molecular weight of 2,000. A steel cathode was plated under the conditions as described in Example 18 and a resultant zinc-iron alloy was of a silver, bright appearance and upon analysis contained 16.4% by weight iron.

EXAMPLE 22

To the electrolyte as described in Example 18, 50 mg/l of an additive was added comprising a diethyl ester phosphated polyethylene glycol of an average molecular weight of 200. A steel cathode was plated under the same conditions as described in Example 18 and the resultant zinc-iron alloy deposit was very lustrous, and of a blue-silver, semi-bright appearance. Upon analysis, the alloy contained 16.7% by weight iron.

EXAMPLE 23

To the electrolyte described in Example 18, 50 mg/l of an additive agent was added comprising a monoethyl ester phosphonated polyethylene glycol of an average molecular weight of 200. A steel cathode was plated in accordance with the procedure described in Example 18 and the resultant zinc-iron alloy deposit was of a semi-bright appearance and on analysis contained 14.7% by weight iron.

EXAMPLE 24

For comparative purposes, an aqueous acidic chloride-type electrolyte was prepared suitable for depositing a zinc-cobalt alloy containing 52 g/l zinc chloride, 10 g/l cobalt chloride hexahydrate, 140 g/l sodium chloride, 30 g/l boric acid and 1.75 g/l sodium benzoate. The pH of the bath was controlled at 4.2 and the temperature was controlled at 25° C.

A test panel was plated in a standard Hull Cell at a current of 1 ampere for a period of 5 minutes employing a zinc anode in the absence of agitation. The plated deposit was of a matte-grey appearance across the entire panel with a small burn at the high current density edge of the panel. Poor throw was observed in the low current density region. The average alloy compositions were 0.7% by weight cobalt in the 20–40 ASF range and 2.5% by weight cobalt in the range above 40 ASF.

EXAMPLE 25

To the electrolyte as described in Example 24, 1 g/l of a terminally aminated block polymer of ethylene and propylene glycol having an average molecular weight of 2,000 was added and a flat steel test panel was plated in the Hull Cell in the same manner as described in Example 24. Upon inspection, the zinc-cobalt alloy deposit exhibited good grain refinement in the 0–30 ASF range and had a bright appearance in the range above 30 ASF. The low current density throw was increased in comparison to that obtained in Example 24. The zinc-cobalt deposit contains an average of 5.3% by weight cobalt in the range above 17 ASF.

EXAMPLE 26

To the electrolyte as described in Example 24, 2 g/l of an additive was added comprising a phosphated polyethylene glycol of a molecular weight of 8,000.

A steel test panel was again plated in the Hull Cell in accordance with the procedure described in Example 24 and the zinc-cobalt alloy deposit was of a lustrous, slightly hazy, semi-bright appearance in the 0–25 ASF range; and a bright appearance in the range above 25 ASF. An increase in the low current density throw was observed in comparison to the results obtained in Example 24. The zinc-cobalt alloy deposit contains an average of 5% by weight cobalt in the range above 20 ASF.

EXAMPLE 27

For comparative purposes, an aqueous acidic electrolyte was prepared of the sulfate-type suitable for depositing a zinc-nickel alloy containing 135 g/l zinc sulfate monohydrate, 230 g/l nickel sulfate hexahydrate, 30 g/l boric acid and 15 g/l ammonium sulfate. The pH of the electrolyte was 4.6 and was controlled at a temperature of 30° C.

A steel test part was plated in the electrolyte at an average cathode current density of 75 ASF for a period of 5 minutes employing zinc anodes and air agitation. The plated deposit was of a grainy, grey appearance and contained 4.3% by weight nickel.

EXAMPLE 28

To the electrolyte described in Example 27, 0.5 g/l of an additive was added comprising a phosphated polyethylene glycol of a molecular weight of 8,000 and a test part was again plated under the conditions described in Example 17. The zinc-nickel alloy deposit was of a reflective fine-grained semi-bright appearance and upon analysis was found to contain 1.9% by weight nickel. The deposit was commercially acceptable and had good adhesion and 100% improved corrosion protection over pure zinc.

EXAMPLE 29

To the electrolyte as described in Example 27, 50 mg/l of an additive was added comprising a terminally aminated block polymer of ethylene and propylene oxides having an average molecular weight of 2,000. A steel test part was plated under the same conditions as described in Example 27 and the zinc-nickel alloy deposit was of a light-grey, reflective and commercially acceptable appearance for functional coatings which upon analysis was found to contain 2.8% by weight nickel.

EXAMPLE 30

To the electrolyte as described in Example 27, 50 mg/l of an additive was added comprising 2,4,7,9-tetramethyl-5-decyne-4,7-diol ethoxylated with 30 moles ethylene oxide which was modified by a replacement of the terminal hydroxyl with a chlorine atom.

A steel test part was again plated employing the procedure as described in Example 27 and the resultant zinc-nickel alloy deposit was of a reflective, fine-grained semi-bright appearance which upon analysis was found to contain 2.1% by weight nickel.

EXAMPLE 31

To the electrolyte as described in Example 9, 30 mg/l of an additive was added comprising a chlorinated 2,4,7,9-tetramethyl-5-decyne-4,7-diol ethoxylated with 30 moles ethylene oxide.

A rotating steel cathode was plated under the same conditions as described in Example 9 and the zinc-nickel alloy deposit was of a semi-bright appearance which upon analysis was found to contain 3.5% by weight nickel, but the alloy was uniform, adherent, and showed no tendency to microcrack. The physical property advantages of this deposit made it commercially useable.

EXAMPLE 32

For comparative purposes, an aqueous acidic electrolyte was prepared suitable for depositing a zinc-cobalt alloy containing 450 g/l zinc sulfate monhydrate, 60 g/l cobalt sulfate hexahydrate and 36 g/l sulfuric acid. The temperature of the electrolyte was controlled at 40° C.

A moving steel strip 4 inches wide was plated for a period of 15 seconds at an average cathode current density of 1,000 ASF employing lead anodes with the cathode traveling through the electrolyte at a velocity of 300 feet per minute. The resultant zinc-cobalt alloy deposit was of a dark-grey, coarse-grain appearance which upon analysis was found to contain 0.17% by weight cobalt.

EXAMPLE 33

To the electrolyte as described in Example 32, 0.3 g/l of an additive was added comprising a phosphated polyethylene glycol of a molecular weight of 8,000. The steel strip cathode was plated under the same conditions as described in Example 32 and the deposit was of a light grey, fine-grain appearance which upon analysis was found to contain 0.31% by weight cobalt. This type of deposit is especially suitable for commercial electroplating for automotive applications.

EXAMPLE 24

To the electrolyte as described in Example 32, 0.3 g/l of an additive was added comprising a chlorinated 2,4,7,9-tetramethyl-5-decyne-4,7-diol ethyoxylated with 30 moles ethylene oxide.

A moving steel strip was again plated under the same conditions as described in Example 32 and the resultant zinc-cobalt alloy deposit exhibited more grain refinement in comparison to that obtained in Example 32 and which upon analysis was found to contain 0.38% by weight cobalt.

EXAMPLE 35

To the electrolyte as described in Example 32, 0.1 g/l of an additive was added comprising a chlorinated polyethylene glycol of a molecular weight of 1,450. A moving steel strip was plated in accordance with the procedure described in Example 32 and the zinc-cobalt alloy deposit was of a silver-blue, fine-grained, semi-bright appearance which upon analysis was found to contain 0.39% by weight cobalt.

EXAMPLE 36

To the electrolyte as described in Example 32, 0.2 g/l of an additive was added comprising an aminated polypropylene glycol of a molecular weight of 400. A moving steel strip was plated employing the same conditions as described in Example 32 and the resultant zinc-cobalt alloy deposit exhibited improved grain refinement in comparison to that obtained in Example 32 which upon analysis was found to contain 0.5% by weight cobalt.

EXAMPLE 37

To the electrolyte as described in Example 32, 1 g/l of an additive was added comprising a diethyl ester phosphonated polyethylene glycol of an average molecular weight of 200. A moving steel strip was again plated under the same conditions as described in Example 32 and the resultant zinc-cobalt alloy deposit was of a bright appearance which upon analysis was found to contain 0.3% by weight cobalt.

EXAMPLE 38

For comparative purposes, an aqueous acidic electrolyte of the chloride-type was prepared suitable for depositing a zinc-nickel alloy containing 100 g/l zinc chloride, 130 g/l nickel chloride hexahydrate and 200 g/l ammonium chloride. The pH of the electrolyte was controlled at 5 and at a temperature of 32° C.

A steel test part was plated for a period of 10 minutes at an average cathode current density of 40 ASF employing air agitation and using zinc anodes. The resultant zinc-nickel alloy deposit was of a matte, non-uniform appearance which upon analysis was found to contain 12.5% by weight nickel.

EXAMPLE 39

To the electrolyte as described in Example 38, 10 mg/l of an additive was added comprising a phosphated polyethylene glycol of a molecular weight of 8,000.

A test part was again plated employing the same procedure as described in Example 38 and the resultant zinc-nickel alloy deposit was of a semi-bright, uniform appearance which upon analysis was found to contain 9.1 by weight nickel.

EXAMPLE 40

An aqueous acidic chloride-type electrolyte was prepared suitable for electrodepositing a decorative zinc-nickel alloy deposit of a semi-bright appearance containing 100 g/l zinc chloride, 130 g/l nickel chloride hexahydrate, 210 g/l ammonium chloride and 10 g/l of sodium acetate. The pH of the electrolyte was about 5. To the foregoing electrolyte, an additive agent was added at a concentration of 5 g/l comprising sulfated 4,4'-(1-methylethylidene)bisphenol ethoxylated with 26 moles ethylene oxide and 0.5 g/l brightening agent consisting of benzylidene acetone.

An automotive part was rack electroplated at an average cathode current density of 20 ASF in the electrolyte controlled at 100° F. in the presence of air agitation. The resultant plated part had a zinc-nickel alloy deposit which was of a fully bright appearance and upon analysis contained 8.3% by weight nickel. These parts were then coated with a yellow chromate, and provided exceptional corrosion resistance in hot automotive environments.

While it will be apparent that the preferred embodiments of the invention disclosed are well calculated to fulfill the objects above stated, it will be appreciated that the invention is susceptible to modification, variation and change without departing from the proper scope of fair meaning of the subjoined claims.

What is claimed is:

1. A process for electrodepositing a zinc alloy on a substrate comprising the steps of contacting a cathodically electrified substrate with an aqueous acid electrolyte comprising zinc ions in an amount sufficient to provide at least 43% by weight zinc in the alloy deposit, at least 1 additional metal ion selected from the group consisting of nickel, cobalt, iron and mixtures thereof, present in an amount sufficient to electrodeposit a zinc alloy which contains a maximum of 57% by weight of all of said additional metals and an additional agent, present in an amount effective to provide grain refinement, adhesion and ductility of the alloy deposit, which addition agent comprises a bath soluble terminally substituted polyoxyalkylene compound derived from the amination, phosphating, chlorination, bromination, phosphonation, and sulfonation as well as combinations thereof of:

(a) polymerized alkylene oxides selected from the group consisting of ethylene oxide, propylene oxide, glycidol, butylene oxide and mixtures thereof; and (b) alkoxylated mono and polyhydroxy compounds selected from the group consisting of hydroxyl containing alkyl, alkenyl, alkynyl, and aryl compounds, as well as mixtures thereof;

and continuing the electrodeposition of the zinc alloy until the desired thickness is obtained.

2. The process as defined in claim 1 including the further step of controlling the temperature of the electrolyte within a range of about 60° to about 180° F.

3. The process as defined in claim 1 including the further step of controlling the temperature of the electrolyte within a range of about 70° to about 140° F.

4. The process as defined in claim 1 in which the step of electrodepositing the zinc alloy is performed at an average cathode current density of about 1 to about 2000 ASF.

5. The process as defined in claim 1 including the further step of controlling the concentration of the zinc ions and either one of the nickel and cobalt ions to provide a zinc alloy containing about 0.1 to about 30% by weight nickel and/or cobalt.

6. The process as defined in claim 1 including the further step of controlling the concentration of the zinc ions, iron ions, and either one of the cobalt ions and nickel ions to electrodeposit a zinc alloy containing from about 1 to about 25% by weight iron, about 0.1 to about 20% nickel or about 0.1 to about 12% cobalt.

7. The process as defined in claim 1 including the further step of controlling the concentration of additive agent within a range of about 0.005 to about 20 g/l.

8. The process as defined in claim 1 including the further step of controlling the concentration of additive agent within a range of about 0.02 to about 5 g/l.

* * * * *